US011806774B2

(12) United States Patent
Hayashi et al.

(10) Patent No.: US 11,806,774 B2
(45) Date of Patent: Nov. 7, 2023

(54) PUNCH TOOL WITH EXPANDED PORTION AND METHOD OF OPERATING THE SAME

(71) Applicant: AMADA CO., LTD., Kanagawa (JP)

(72) Inventors: Shiro Hayashi, Kanagawa (JP); Nobuo Oyamada, Kanagawa (JP); Yousuke Onagi, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 0 days.

(21) Appl. No.: 17/764,602

(22) PCT Filed: Sep. 29, 2020

(86) PCT No.: PCT/JP2020/036791
§ 371 (c)(1),
(2) Date: Mar. 29, 2022

(87) PCT Pub. No.: WO2021/065856
PCT Pub. Date: Apr. 8, 2021

(65) Prior Publication Data

US 2022/0379361 A1 Dec. 1, 2022

(30) Foreign Application Priority Data

Oct. 3, 2019 (JP) ..... 2019-182635

(51) Int. Cl.
*B21D 5/02* (2006.01)

(52) U.S. Cl.
CPC ..... *B21D 5/0218* (2013.01)

(58) Field of Classification Search
CPC ..... B21D 5/0218; B21D 5/0209; B21D 5/02; B21D 5/01; B21D 11/22
See application file for complete search history.

(56) References Cited

U.S. PATENT DOCUMENTS 4,660,402 A * 4/1987 Hongo ..... B21D 5/04 72/478
2003/0064871 A1 4/2003 Akami
2017/0297073 A1 10/2017 Sato

FOREIGN PATENT DOCUMENTS

JP 2002-178038 A 6/2002
JP 2004-58106 A 2/2004
(Continued)

OTHER PUBLICATIONS

Extended European Search Report for corresponding EP Application No. 20871154.9 dated Oct. 25, 2022.
(Continued)

*Primary Examiner* — Debra M Sullivan
(74) *Attorney, Agent, or Firm* — Renner, Otto, Boisselle & Sklar, LLP

(57) ABSTRACT

A punch tool with an expanded portion, a movable punch provided on a fixed punch so as to be able to move up and down in a direction along an inclined portion, and an interlocking member configured to interlock with a relative ascending and descending motion of the movable punch with respect to the fixed punch. The punch tool with an expanded portion is provided with an operation member provided on the fixed punch so as to be movable in the lateral direction, configured to move in the lateral direction by means of a moving motion of an external operation member, and including an abutting element capable of being abutted with the interlocking member, and an urging member configured to urge the operation member toward the inside in the lateral direction such that the abutting element is abutted with the interlocking member.

7 Claims, 10 Drawing Sheets

(56) References Cited

FOREIGN PATENT DOCUMENTS

| | | | | |
|---|---|---|---|---|
| JP | 2007-203310 | A | | 8/2007 |
| JP | 4672868 | B2 | | 1/2011 |
| JP | 2011050970 | A | * | 3/2011 |
| JP | 5555459 | B2 | | 7/2014 |
| JP | 2015-3330 | A | | 1/2015 |
| JP | 2016-112667 | A | | 6/2016 |
| JP | 5947861 | B2 | | 7/2016 |
| JP | 2018-20335 | A | | 2/2018 |

OTHER PUBLICATIONS

International Search Report for corresponding Application No. PCT/JP2020/036791, dated Dec. 8, 2020.
Written Opinion for corresponding Application No. PCT/JP2020/036791, dated Dec. 8, 2020.

* cited by examiner

PUNCH TOOL WITH EXPANDED PORTION AND METHOD OF OPERATING THE SAME

TECHNICAL FIELD

The present disclosure relates to a punch tool with an expanded portion used when bending such as box bending is performed on a plate-shaped workpiece (a sheet metal), and a method of operating the punch tool with an expanded portion.

BACKGROUND ART

In the field of bending by press brakes, a box-shaped product including side flanges (inner flanges) may be manufactured by sequentially bending a plurality of portions to be bent of a plate-shaped workpiece to perform box-bending of a sheet metal W. When box bending is performed on the workpiece, a punch tool with an expanded portion is used to avoid interference with the side flange of the workpiece or the product. The punch tool with an expanded portion is retained by a punch holder fixed to the lower end portion of an upper table of the press brake.

The punch tool with an expanded portion is provided with a fixed punch including an inclined portion inclined with respect to the vertical direction, and a movable punch provided on the fixed punch so as to be able to move up and down along the inclined portion. The movable punch includes an expanded portion projecting toward the outside in the lateral direction. Further, the punch tools each with an expanded portion are roughly classified into two types. The first type of the punch tool with an expanded portion is configured such that the movable punch protrudes downward with respect to the fixed punch before coming into contact with the workpiece (see Patent Literatures 1 and 2). The second type of the punch tool with an expanded portion is configured such that the distal end of the movable punch is aligned with the distal end of the fixed punch before coming into contact with the workpiece (see Patent Literature 3).

The first type of the punch tool with an expanded portion is equipped with a coupling link that couples the fixed punch and the movable punch. One end portion of the coupling link is rotatably coupled to the fixed punch, and the other end portion of the coupling link is rotatably coupled to the movable punch. Further, the first type of the punch tool with an expanded portion is configured such that when the distal end of the movable punch comes into contact with the workpiece due to the descending motion of the upper table, the movable punch moves up relatively to the fixed punch until the distal end of the movable punch is aligned with the distal end of the fixed punch.

Then, in the first type of the punch tool with an expanded portion, when the fixed punch is moved up by way of the ascending motion of the upper table immediately after the portion to be bent of the workpiece is bent, the movable punch moves toward the inside in the lateral direction so as to avoid interference between the expanded portion and the side flange while moving down relatively to the fixed punch due to a self-weight thereof. As a result, even when the side flange is positioned directly above the expanded portion, the punch tool with an expanded portion can be pulled out from the workpiece or the product while avoiding the interference between the expanded portion and the side flange (see Patent Literatures 1 and 2).

The second type of the punch tool with an expanded portion is provided with an air cylinder having a movable element that is provided on the fixed punch and can move up and down in the direction along the inclined portion of the fixed punch, and a hook member that is provided on the movable element and can be engaged with an engaged portion of the movable punch from below. The air cylinder causes the movable punch to move up and down relatively to the fixed punch in the direction along the inclined portion of the fixed punch with the hook member being engaged with the engaged portion of the movable punch. The second type of the punch tool with an expanded portion is configured such that the distal end of the movable punch is aligned with the distal end of the fixed punch with the hook member being engaged with the engaged portion of the movable punch before coming into contact with the workpiece.

Then, in the second type of the punch tool with an expanded portion, in a case where the side flange is positioned directly above the expanded portion immediately after the portion to be bent of the workpiece is bent, first, the air cylinder is driven to move down the movable element so that the engaged state between the hook member and the engaged portion is released. After that, when the fixed punch is moved up by way of the ascending motion of the upper table, the movable punch moves toward the inside in the lateral direction so as to avoid interference between the expanded portion and the side flange while moving down relatively to the fixed punch due to a self-weight thereof. As a result, the punch tool with an expanded portion can be pulled out from the workpiece or the product while avoiding the interference between the expanded portion and the side flange (see Patent Literature 3).

It should be noted that Patent Literatures 4 to 8 also show the prior arts related to the present disclosure, in addition to the ones shown in Patent Literatures 1 to 3.

CITATION LIST

Patent Literature

Patent Literature 1: Japanese Patent Application Laid-Open Publication No. 2004-58106

Patent Literature 2: Japanese Patent Application Laid-Open Publication No. 2002-178038

Patent Literature 3: Japanese Patent Application Laid-Open Publication No. 2018-20335

Patent Literature 4: Japanese Patent Application Laid-Open Publication No. 2015-3330

Patent Literature 5: Japanese Patent Application Laid-Open Publication No. 2007-203310

Patent Literature 6: Japanese Patent No. 4672868

Patent Literature 7: Japanese Patent No. 5947861

Patent Literature 8: Japanese Patent Application Laid-Open Publication No. 2016-112667

SUMMARY

Now, in the first type of the punch tool with an expanded portion, when the press brake is equipped with an optical safety device (see Patent Literatures 4 and 5, and the like), the movable punch blocks a monitoring beam from a projector of the optical safety device. Therefore, it is not possible to perform a monitoring operation by the optical safety device, and accordingly, the upper table can be moved down only at a low speed.

Further, in the second type of the punch tool with an expanded portion, although the movable punch does not block the monitoring beam from the projector of the optical safety device, the air cylinder that moves the movable punch up and down relatively to the fixed punch is an essential component. Therefore, the size of the punch tool with an expanded portion becomes larger, and the configuration of the punch tool with an expanded portion, which includes air piping for supplying air to the air cylinder, becomes more complicated.

In other words, there is a problem that when the press brake is equipped with the optical safety device, it is difficult to stably perform a monitoring operation by the optical safety device while suppressing the increase in size and the complexity of the configuration of the punch tool with an expanded portion.

Accordingly, the present disclosure aims to provide a punch tool with an expanded portion in which an actuator is excluded from the components thereof and a monitoring beam from a projector of an optical safety device is not blocked when the press brake is equipped with the optical safety device, and a method of operating the same.

According to a first aspect of one or more embodiments, there is provided a punch tool with an expanded portion that includes a fixed punch including an inclined portion inclined with respect to a vertical direction, a movable punch provided on the fixed punch so as to be able to move up and down in a direction along the inclined portion and including an expanded portion projecting toward an outside in a lateral direction, an interlocking member configured to interlock with a relative ascending and descending motion of the movable punch, an operation member provided on the fixed punch so as to be movable in the lateral direction, the operation member being configured to move in the lateral direction by means of a moving motion (a moving operation) of an external operation member, the operation member including an abutting element capable of being abutted with the interlocking member, the operation member being configured to perform the relative ascending and descending motion of the movable punch, and an urging member configured to urge the operation member toward an inside in the lateral direction such that the abutting element is abutted with the interlocking member. The punch tool with an expanded portion is configured such that a distal end of the movable punch is aligned with a distal end of the fixed punch with the abutting element being abutted with the interlocking member before coming into contact with a plate-shaped workpiece (a sheet metal).

According to a second aspect of the one or more embodiments, there is provided a method of operating a punch tool with an expanded portion, the punch tool with an expanded portion including a fixed punch including an inclined portion inclined with respect to a vertical direction, a movable punch provided to the fixed punch so as to be able to move up and down in a direction along the inclined portion and including an expanded portion projecting toward an outside in a lateral direction, an interlocking member configured to interlock with a relative ascending and descending motion of the movable punch with respect to the fixed punch, an operation member provided on the fixed punch so as to be movable in the lateral direction, including an abutting element capable of being abutted with the interlocking member, and configured to perform the relative ascending and descending motion of the movable punch, and an urging member configured to urge the operation member toward an inside in the lateral direction such that the abutting element is abutted with the interlocking member, in which, in a case where a side flange (an inner flange) of the workpiece or a product is positioned directly above the expanded portion immediately after a portion to be bent of a plate-shaped workpiece (a sheet metal) is bent, a moving motion of an external operation member causes the operation member to move toward the outside in the lateral direction against an urging force of the urging member when the punch tool with an expanded portion is moved up relatively to the die tool, thereby the movable punch moves toward the inside in the lateral direction so as to avoid interference between the expanded portion and the side flange while moving down relatively to the fixed punch due to a self-weight thereof.

According to the one or more embodiments, when the press brake is equipped with an optical safety device, the monitoring operation by the optical safety device can be stably performed while suppressing the increase in size and the complexity of the configuration of the punch tool with an expanded portion.

BRIEF DESCRIPTION OF DRAWINGS

FIGS. 3(*a*) and 3(*b*) each shows a state in which a movable punch is positioned at the ascending end on a fixed punch.

FIGS. 4(*a*) and 4(*b*) each shows a state in which the movable punch is positioned at the descending end on the fixed punch.

FIG. 5(*b*) is a perspective view of the punch tool with an expanded portion according to the embodiment, and shows a state in which the movable punch is positioned at the descending end on the fixed punch.

DESCRIPTION OF EMBODIMENT

Figure 1:
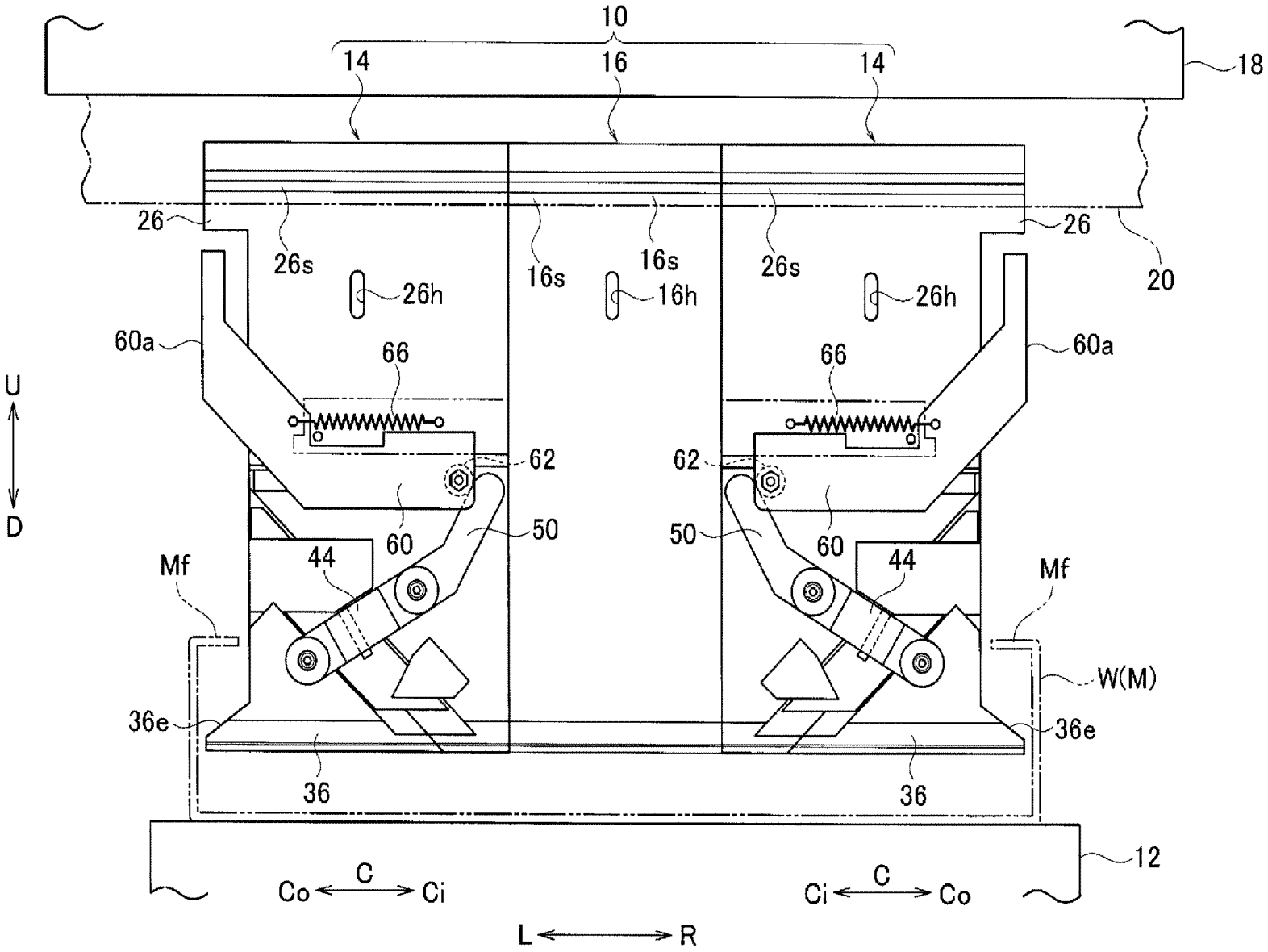
FIG. 1 is a front view of a punch tool assembly for box bending and a periphery thereof according to an embodiment.

Hereinafter, an embodiment will be described with reference to FIGS. 1 to 10.

It should be noted that in the description and the claims of the present application, "provided" means not only directly provided but also indirectly provided via another member. Further, the "lateral direction" refers to the lateral direction of the punch tool with an expanded portion or the lateral direction of the punch tool assembly for box bending, and refers to the left-right direction that is one of the horizontal directions. The "outside in the lateral direction" refers to a direction that is one side of the lateral direction and is separating from the center side of the punch tool with an expanded portion. The "inside in the lateral direction" refers to a direction that is one side of the lateral direction and is opposite to the outside in the lateral direction. In the drawings, "FF" indicates the front direction, "FR" indicates the rear direction, "C" indicates the lateral direction, "Co" indicates the outside in the lateral direction, "Ci" indicates the inside in the lateral direction, "L" indicates the left direction, "R" indicates the right direction, "U" indicates the upward direction, and "D" indicates the downward direction.

Figure 2:
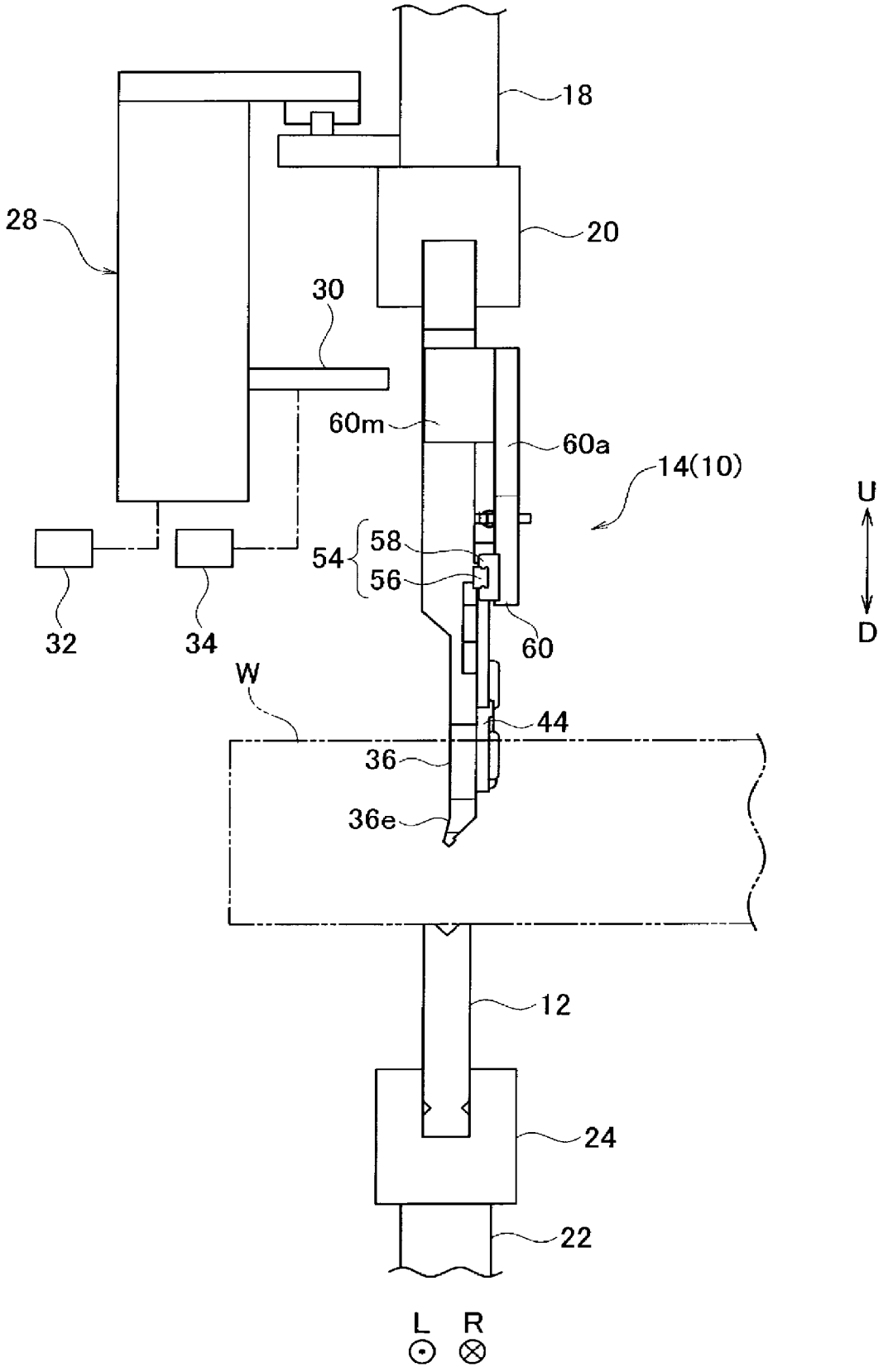
FIG. 2 is a left side view of the punch tool assembly for box bending and the periphery thereof according to the embodiment.

As shown in FIGS. 1 and 2, a punch tool assembly for box bending 10 according to the embodiment is used when box-bending (an example of bending) of a plate-shaped workpiece (a sheet metal) W is performed in cooperation with a die tool 12. In other words, the punch tool assembly for box bending 10 is used when a box-shaped product M including side flanges (inner flanges) Mf is manufactured by performing box bending on the workpiece W. The punch tool assembly for box bending 10 includes a pair of punch tools each with an expanded portion 14 and an intermediate punch tool 16 arranged between the pair of punch tools each with an expanded portion 14. The punch tool assembly for box bending 10 is retained by a punch holder 20 fixed to the lower end portion of an upper table 18 of a press brake. The die tool 12 is retained by a die holder 24 fixed to the upper end portion of the lower table 22 of the press brake.

Next, a specific configuration of the punch tool with an expanded portion 14 in the punch tool assembly for box bending 10 will be described.

As shown in FIGS. 2 to 5, the punch tool with an expanded portion 14 is provided with a fixed punch 26. The fixed punch 26 includes a shank 26*s* retained by the punch holder 20 on the base end side (upper end side) thereof. The fixed punch 26 includes an inclined portion (inclined surface) 26*g* that is inclined with respect to the vertical direction on the outside in the lateral direction on the distal end side (lower end side). On the fixed punch 26, a recessed step portion 26*u* is formed along the inclined portion 26*g*. Further, a protruding portion 26*b* protruding downward is formed at the upper end portion of the inclined portion 26*g* of the fixed punch 26. An engagement hole 26*h* for engaging a tool retention member 30 in a punch tool changing unit 28 is formed in the vicinity of the shank 26*s* of the fixed punch 26.

Here, the punch tool changing unit 28 is provided on the back side of the upper table 18 so as to be movable in the left-right direction and changes the punch tool such as the punch tool with an expanded portion 14 for the punch holder 20. The punch tool changing unit 28 including the tool retention member 30 has a known configuration shown in Patent Literatures 6 and 7. A servomotor 32 that retains the punch tool is driven as an actuator for movement in the left-right direction, which causes the punch tool changing unit 28 including the tool retention member 30 to move in the left-right direction with respect to the upper table 18. An air cylinder 34 is driven as an actuator for movement in the front-rear direction, which causes the tool retention member 30 to move in the front-rear direction with respect to the upper table 18 (see FIG. 2).

Figure 3:
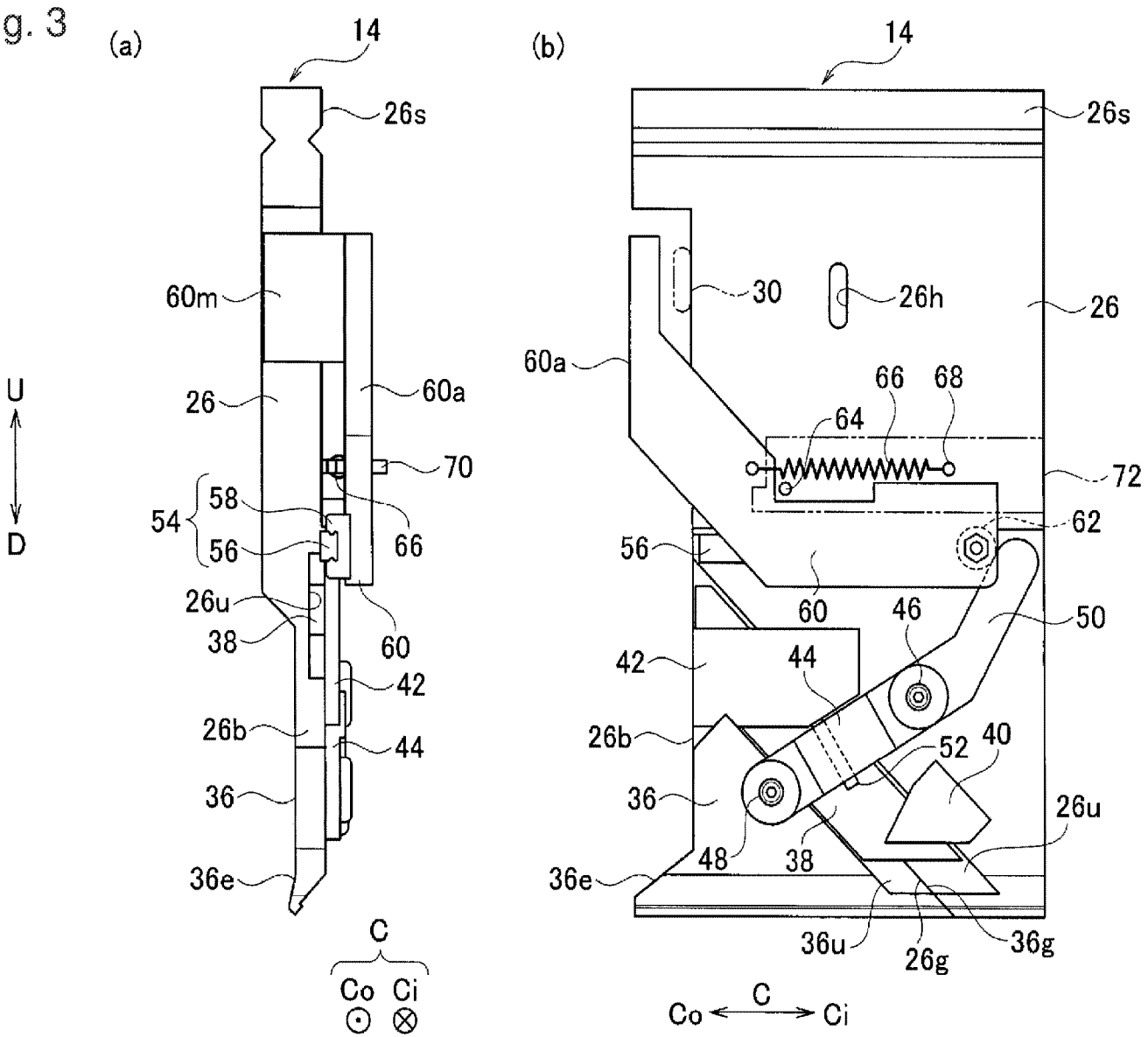
FIG. 3(*a*) is a side view of a punch tool with an expanded portion according to the embodiment, and FIG. 3(*b*) is a front view of the punch tool with an expanded portion according to the embodiment.
Figure 4:
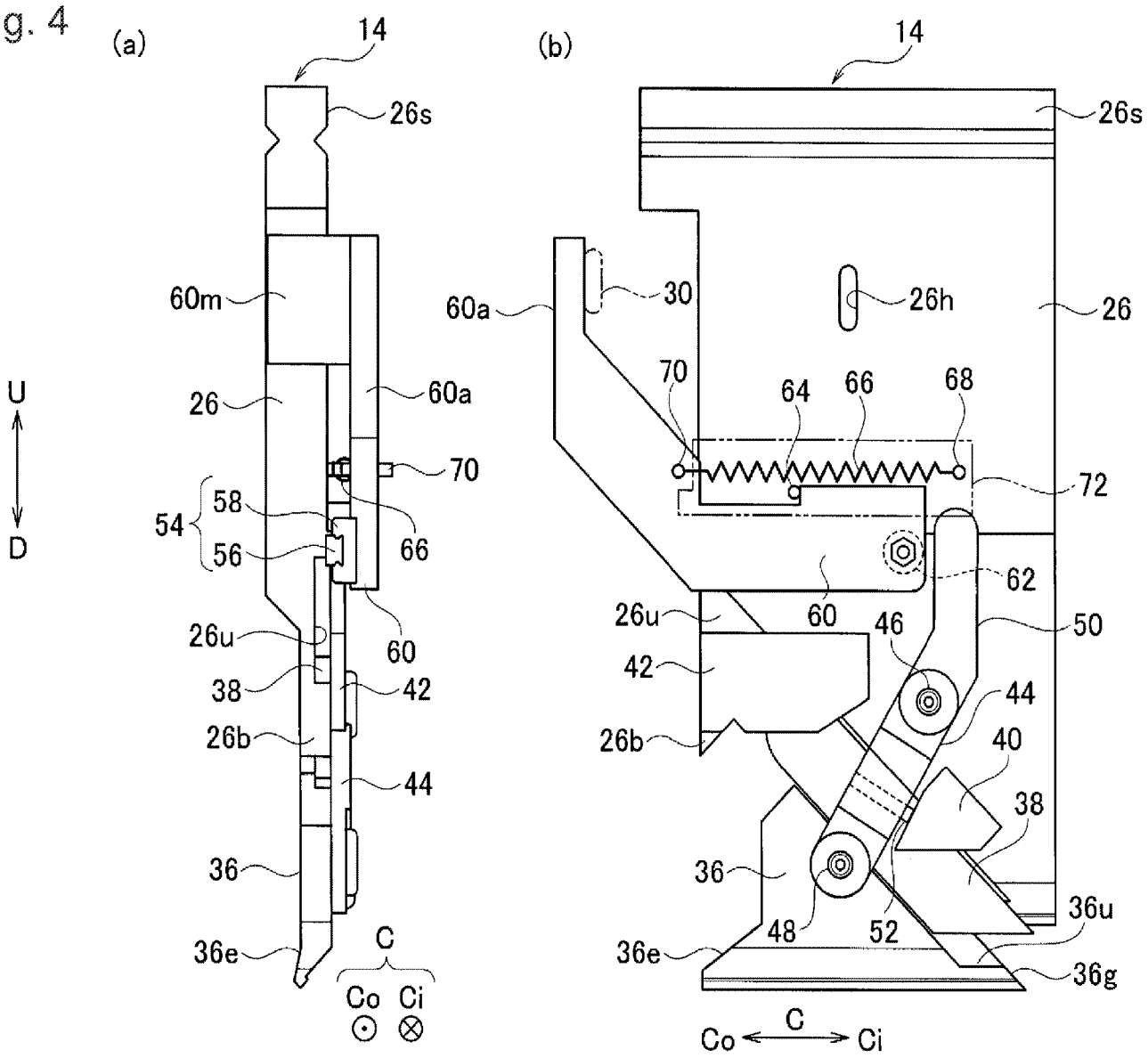
FIG. 4(*a*) is a side view of the punch tool with an expanded portion according to the embodiment, and FIG. 4(*b*) is a front view of the punch tool with an expanded portion according to the embodiment.
Figure 5:
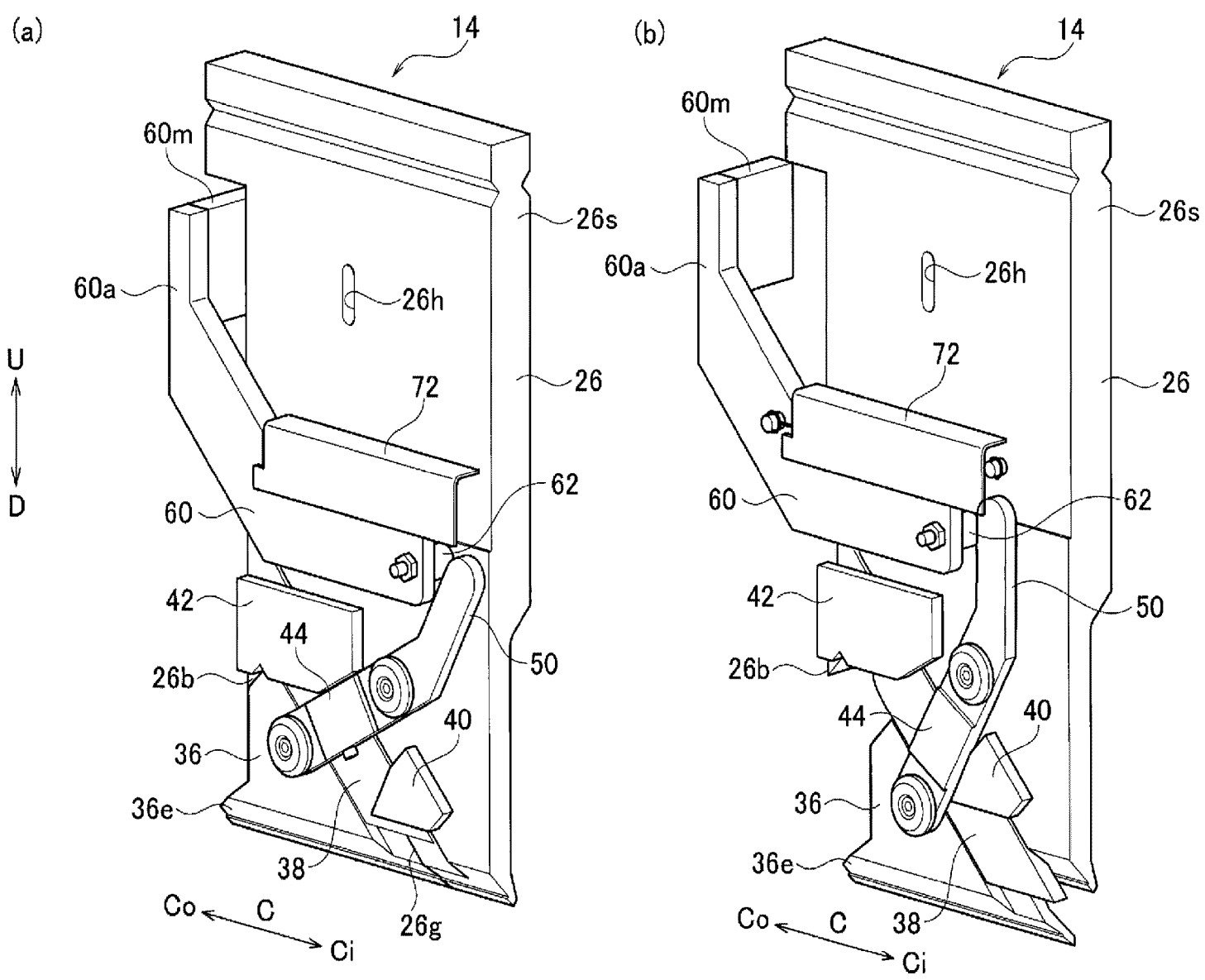
FIG. 5(*a*) is a perspective view of the punch tool with an expanded portion according to the embodiment, and shows a state in which the movable punch is positioned at the ascending end on the fixed punch.

As shown in FIGS. 3 to 5, a movable punch 36 is provided to the inclined portion 26*g* of the fixed punch 26 so as to be able to move up and down in the direction along the inclined portion 26*g*. The movable punch 36 includes a mating inclined portion (a mating inclined surface) 36*g* that contacts and faces the inclined portion 26*g* of the fixed punch 26. The movable punch 36 includes an expanded portion 36*e* that projects toward the outside in the lateral direction on the distal end side (lower end side) thereof. Further, the movable punch 36 moves up and down relatively to the fixed punch 26 in the direction along the inclined portion 26*g* of the fixed punch 26 between the ascending end and the descending end on the fixed punch 26. When the movable punch 36 is positioned at the ascending end on the fixed punch 26, the distal end of the movable punch 36 is aligned with the distal end of the fixed punch 26. When the movable punch 36 is positioned at the ascending end on the fixed punch 26, the movable punch 36 is abutted with the protruding portion 26*b* of the fixed punch 26. In other words, the protruding portion 26*b* of the fixed punch 26 has a function as a stopper to regulate the relative ascending and descending motion of the movable punch 36.

On the movable punch 36, a recessed step portion 36*u* is formed along a mating inclined portion 36*g*. At the stepped portion 36*u* of the movable punch 36, a sliding contact plate 38 that slidably contacts the stepped portion 26*u* of the fixed punch is integrally provided via a plurality of mounting bolts (not shown). The sliding contact plate 38 can also be regarded as a part of the movable punch 36. Further, a first retention plate 40 for retaining the lower end side of the sliding contact plate 38 so as to be slidably contactable is provided on the side far from the protruding portion 26*b* on the side of the stepped portion 26*u* of the fixed punch 26. A second retention plate 42 for retaining the upper end side of the sliding contact plate 38 so as to be slidably contactable is provided on the side close to the protruding portion 26*b* on the side of the stepped portion 26*u* of the fixed punch 26.

The punch tool with an expanded portion 14 includes a coupling link 44 that couples the fixed punch 26 and the movable punch 36. One end portion of the coupling link 44 is rotatably coupled to the fixed punch 26 via a coupling pin 46, and the other end portion of the coupling link 44 is rotatably coupled to the movable punch 36 via a coupling pin 48. It should be noted that instead of the coupling link 44 provided to the punch tool with an expanded portion 14, as shown in Patent Literature 3, a guide plate (not shown) may be provided on the fixed punch 26 and a guide hole (not shown) parallel to the inclined portion 26*g* of the fixed punch 26 may be formed on the guide plat. In this case, a guide roller (not shown) that is guided to the guide hole of the guide plate is provided on the movable punch 36.

At one end portion of the coupling link 44, an interlocking member 50 that moves in the lateral direction in interlock with the relative ascending and descending motion of the movable punch 36 is integrally provided. In other words, the interlocking member 50 is coupled to the movable punch 36 via the coupling link 44. The interlocking member 50 is interlockingly moved toward the inside in the lateral direction by way of the relative ascending motion of the movable punch 36. The interlocking member 50 is interlockingly moved toward the outside in the lateral direction by way of the relative descending motion of the movable punch 36. The interlocking member 50 is composed of a member common to the coupling link 44. The interlocking member 50 can also be regarded as a part of the coupling link 44. As described above, when the punch tool with an expanded portion 14 is provided with the guide plate and the guide roller instead of the coupling link 44, the interlocking member 50 is coupled to the movable punch 36 or a roller shaft of the guide roller.

In the middle of the coupling link 44, an abutting screw 52 is provided. When the movable punch 36 is positioned at the descending end on the fixed punch 26, the abutting screw 52 is abutted with the first retention plate 40. The first retention plate 40 has a function as a stopper to regulate the relative descending motion of the movable punch 36.

On the surface of the fixed punch 26, an LM (Linear Motion) guide 54 is provided. The LM guide 54 includes an LM rail 56 provided on the surface of the fixed punch 26 and extending in the lateral direction, and an LM block 58 provided on the LM rail 56 so as to be movable in the lateral direction. Further, the LM block 58 is provided with an operation member 60 for performing a relative ascending and descending motion of the movable punch 36 so as to be movable in the lateral direction. In other words, on the surface of the fixed punch 26, the operation member 60 is provided via the LM guide 54 so as to be movable in the lateral direction.

The operation member 60 includes an arm part 60*a* extending upward on the outside in the lateral direction of the operation member 60. The operation member 60 includes, as an external operation member, an operated part 60*m* in a flat plate shape for abutting the tool retention member 30 on the distal end side of the arm part 60*a*. The operated part 60*m* is positioned at the same height position as the engagement hole 26*h* of the fixed punch 26. The left-right moving motion of the tool retention member 30 causes the operation member 60 to move in the lateral direction with the tool retention member 30 being abutted with the operated part 60*m*. The servomotor 32 is driven to move the tool retention member 30 to the left or to the right, which causes the tool retention member 30 to be abutted with the operated part 60*m* while being moved in the forward direction with the driving of the air cylinder 34. It should be noted that instead of including the operated part 60*m* for abutting the tool retention member 30, the operation member 60 may include an operated part (not shown) for engaging the tool retention member 30.

The operation member 60 includes a cam follower 62 as an abutting element capable of being abutted with the interlocking member 50 on the inside in the lateral direction thereof. The cam follower 62 constitutes a part of the operation member 60. The cam follower 62 is rotatable around a horizontal axis orthogonal to the lateral direction. Further, the fixed punch is provided with a stopper 64 in a pin shape for regulating the movement of the operation member 60 toward the outside in the lateral direction, and the stopper 64 can be abutted with a part of the operation member 60.

A tension spring 66 as an urging member is provided between the fixed punch 26 and the operation member 60, and the tension spring 66 urges the operation member 60 toward the inside in the lateral direction so that the cam follower 62 is abutted with the interlocking member 50. One end portion of the tension spring 66 is fixed to the fixed punch 26 via a fastening screw 68, and the other end portion of the tension spring 66 is fixed to the operation member 60 via a fastening screw 70. Further, a protective cover 72 for protecting the tension spring 66 is provided to the operation member 60. It should be noted that instead of being provided with the tension spring 66 as an urging member, the punch tool with an expanded portion 14 may be provided with a compression spring (not shown) or an elastic body made of urethane or the like (not shown).

The punch tool with an expanded portion 14 is configured such that the movable punch 36 is positioned at the ascending end on the fixed punch 26 with the cam follower 62 being abutted with the interlocking member 50 by an urging force of the tension spring 66 before coming into contact with the workpiece W. In other words, the punch tool with an expanded portion 14 is configured such that the distal end of the movable punch 36 is aligned with the distal end of the fixed punch 26 with the cam follower 62 being abutted with the interlocking member 50 by the urging force of the tension spring 66 before coming into contact with the workpiece W.

The punch tool with an expanded portion 14 is configured such that the stopper 64 is abutted with a part of the operation member 60 immediately after the operation member 60 moves toward the outside in the lateral direction against the urging force of the tension spring 66 and the movable punch 36 is positioned at the descending end on the fixed punch 26. In other words, the punch tool with an expanded portion 14 is configured such that the abutting state between the cam follower 62 and the interlocking member 50 is released immediately after the operation member 60 moves toward the outside in the lateral direction against the urging force of the tension spring 66 and the movable punch 36 is positioned at the descending end on the fixed punch 26.

Next, with reference to FIG. 1, a configuration of the intermediate punch tool 16 in the punch tool assembly for box bending 10 will be briefly described.

As shown in FIG. 1, a side surface shape and a side cross-sectional shape of the intermediate punch tool 16 are the same. The side surface shape (the side cross-sectional shape) of the intermediate punch tool 16 is the same as the side surface shape of the fixed punch 26 on the inside in the lateral direction. Further, the intermediate punch tool 16 includes a shank 16*s* retained by the punch holder 20 on the base end side (the upper end side) thereof. An engagement hole 16*h* for engaging the tool retention member 30 is formed in the vicinity of the shank 16*s* of the intermediate punch tool 16. It should be noted that instead of being provided with one intermediate punch tool 16, the punch tool assembly for box bending 10 may be provided with a plurality of the intermediate punch tools 16. The intermediate punch tool 16 may be excluded from the components of the punch tool assembly for box bending 10.

Next, the operation and the effect of the embodiment will be described, including the method of operating the punch tool with an expanded portion according to the embodiment. The method of operating the punch tool with an expanded portion according to the embodiment is a method of operating the punch tool with an expanded portion 14.

[Normal Operation of the Embodiment]

The workpiece W is set on the die tool 12 such that a portion to be bent of the workpiece W held by an operator (not shown) or a bending robot (not shown) is positioned at a predetermined position of the die tool 12 (on the center line of a V groove of the die tool 12). Then, with the distal end of the movable punch 36 being aligned with the distal end of the fixed punch 26, the punch tool assembly for box bending 10 is moved down by way of the descending motion of the upper table 18. As a result, the portion to be bent of the workpiece W can be bent by the cooperation between the punch tool assembly for box bending 10 and the die tool 12. After that, the punch tool assembly for box bending 10 is moved up by way of the ascending motion of the upper table 18 so that the punch tool assembly for box bending 10 is separated from the die tool 12. It should be noted that the processing robot has a known configuration shown, for example, in Patent Literature 8 and the like, and is an articulated robot for assisting in bending of the workpiece W.

By appropriately repeating the above-mentioned operation, a plurality of the portions to be bent of the workpiece W held by the operator or the bending robot can be sequentially bent to perform box bending of the workpiece W so that the box-shaped product M including the side flanges Mf can be manufactured.

[Method of Operating the Punch Tool with an Expanded Portion]

Figure 6:
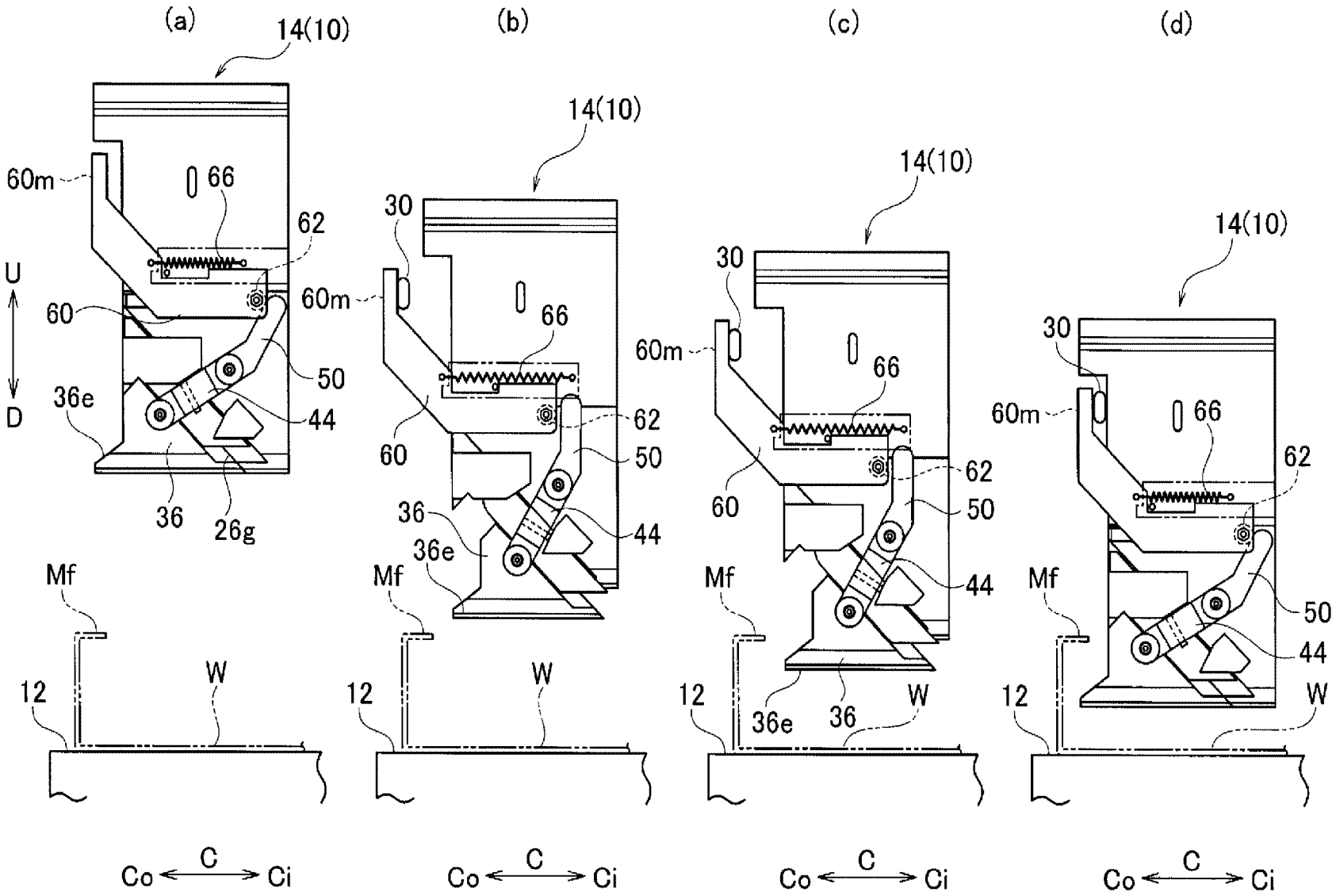
FIGS. 6(*a*), 6(*b*), 6(*c*) and 6(*d*) are diagrams for describing a method of operating the punch tool with an expanded portion.
Figure 7:
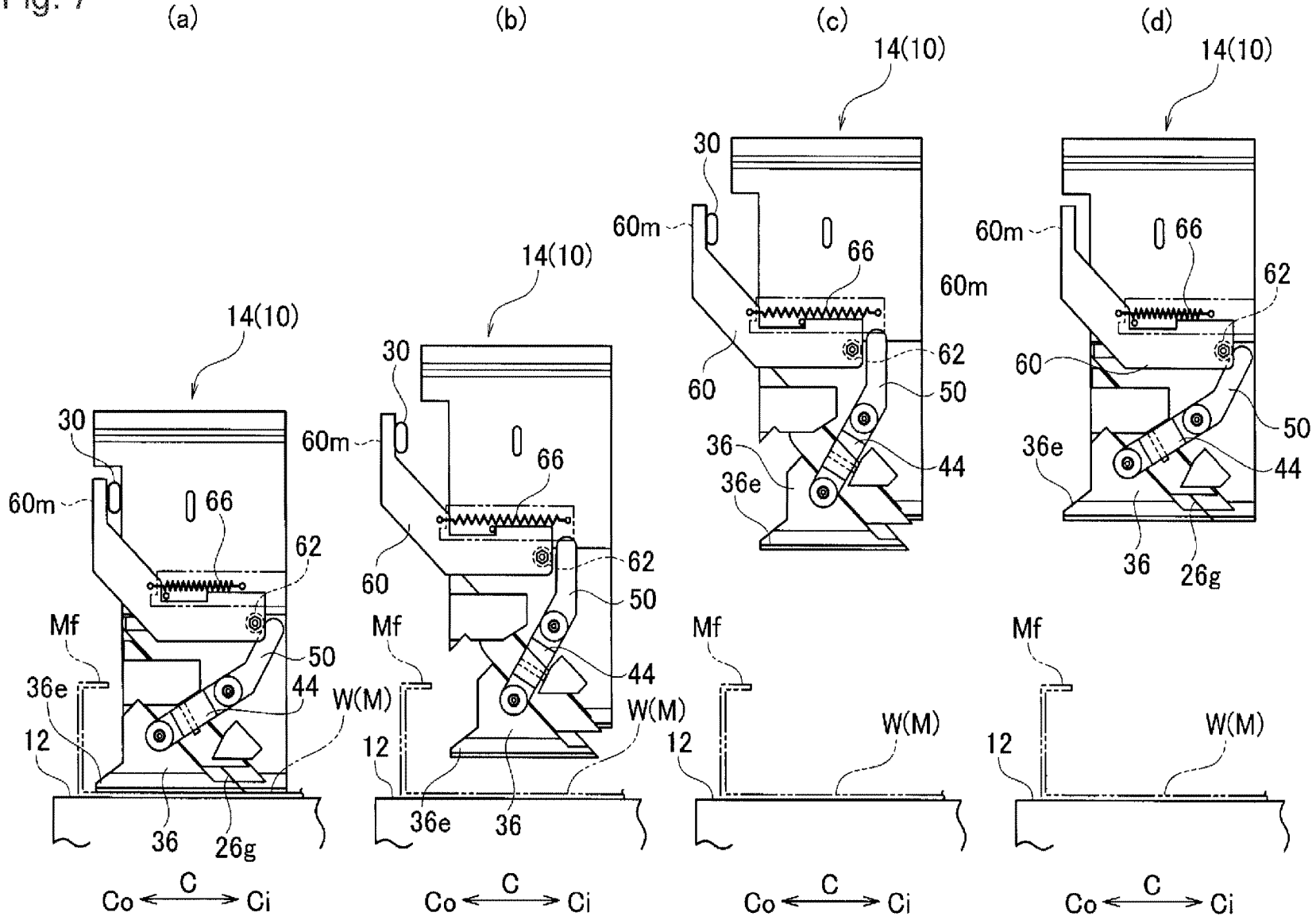
FIGS. 7(*a*), 7(*b*), 7(*c*) and 7(*d*) are diagrams for describing the method of operating the punch tool with an expanded portion.

As shown in FIGS. 6 and 7, the following operation will be performed in a case where the side flange Mf is positioned directly under the expanded portion 36*e* before any one of the portions to be bent of the workpiece W held by the operator is bent.

The punch tool assembly for box bending 10 is moved up at a high speed by way of the descending motion of the upper table 18 until the punch tool assembly for box bending 10 (the punch tool with an expanded portion 14) is positioned at a predetermined first height position slightly higher than the height of the side flange Mf (see FIGS. 6(*a*) and 6(*b*)). Immediately after the punch tool assembly for box bending 10 is positioned at the predetermined first height position, the punch tool assembly for box bending 10 is moved down at a low speed (see FIGS. 6(*c*) and 6(*d*)). Immediately before switching the descending speed of the punch tool assembly for box bending 10 to a low speed, a monitoring operation by an optical safety device (see Patent Literatures 4 and 5, and the like) is turned off. It should be noted that the optical safety device has a known configuration shown in, for example, Patent Literatures 4 and 5, and monitors intrusion of a foreign matter between the punch tool such as the punch tool assembly for box bending 10 and the die tool 12.

Immediately after switching the descending speed of the punch tool assembly for box bending 10 to a low speed, the tool retention member 30 is moved to one side in the left-right direction. The moving motion of the tool retention member 30 causes the operation member 60 to move toward the outside in the lateral direction against the urging force of the tension spring 66. Then, the movable punch 36 moves toward the inside in the lateral direction so as to avoid interference between the expanded portion 36*e* and the side flange Mf while moving down relatively to the fixed punch 26, due to a self-weight thereof, up to the descending end on the fixed punch 26 (See FIGS. 6(*b*) and 6(*c*)). After the entire expanded portion 36*e* is positioned at a height position lower than the side flange Mf, the tool retention member 30 is moved to the other side in the left-right direction. When the moving motion of the tool retention member 30 is performed, in combination with the urging force of the tension spring 66, the operation member 60 moves toward the inside in the lateral direction. Then, with the cam follower 62 and the interlocking member 50 being abutted with each other, the movable punch 36 moves toward the outside in the lateral direction so that the expanded portion 36*e* is positioned directly below the side flange Mf while moving up relatively with respect to the fixed punch 26 up to the ascending end on the fixed punch 26 ((See FIGS. 6(*c*) and 6(*d*)), a first interference avoiding operation of the punch tool with an expanded portion 14). As a result, the portion to be bent of the workpiece W can be bent while avoiding interference between the expanded portion 36*e* and the side flange Mf (see FIG. 7(*a*)).

Further, as shown in FIG. 7, the following operation will be performed in a case where the side flange Mf is positioned directly above the expanded portion 36*e* immediately after any one of the portions to be bent of the workpiece W with the side flange Mf held by the operator is bent.

When the punch tool assembly for box bending 10 (the punch tool with an expanded portion 14) is moved up by way of the ascending motion of the upper table 18, the tool retention member 30 is moved to one side in the left-right direction. The moving motion of the tool retention member 30 causes the operation member 60 to move toward the outside in the lateral direction against the urging force of the tension spring 66. Then, the movable punch 36 moves toward the inside in the lateral direction so as to avoid interference between the expanded portion 36*e* and the side flange Mf while moving down relatively to the fixed punch 26, due to a self-weight thereof, up to the descending end on the fixed punch 26 ((See FIGS. 7(*a*) and 7(*b*)), a second interference avoiding operation of the punch tool with an expanded portion 14). As a result, the punch tool with an expanded portion 14 can be pulled out from the workpiece W or the product M while avoiding interference between the expanded portion 36*e* and the side flange Mf (see FIG. 7(*c*)).

It should be noted that the tool retention member 30 is moved to the other side in the left-right direction after the punch tool assembly for box bending 10 is positioned at the original height position (ascending end). When the moving motion of the tool retention member 30 is performed, in combination with the urging force of the tension spring 66, the operation member 60 moves toward the inside in the lateral direction. Then, with the cam follower 62 and the interlocking member 50 being abutted with each other, the movable punch 36 moves up relatively to the fixed punch 26 up to the ascending end on the fixed punch 26. As a result, the punch tool with an expanded portion 14 can be returned to the original state (initial state) (see FIGS. 7(*c*) and 7 (*d*)).

Figure 8:
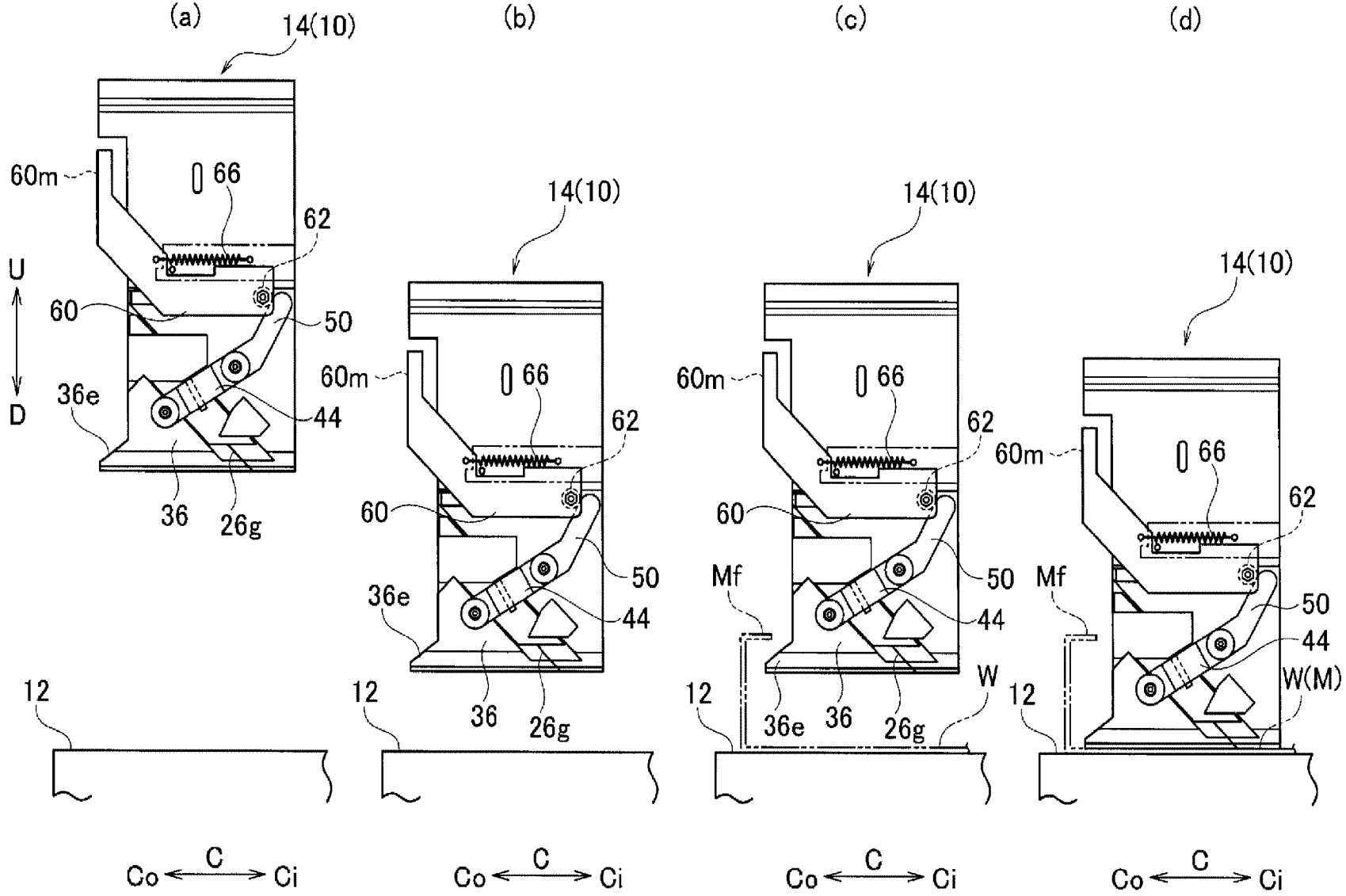
FIGS. 8(*a*), 8(*b*), 8(*c*) and 8(*d*) are diagrams for describing the method of operating the punch tool with an expanded portion.

Furthermore, as shown in FIG. 8, the following operation may be performed before any one of the portions to be bent of the workpiece W held by the operator is bent.

The punch tool assembly for box bending 10 (the punch tool with an expanded portion 14) is moved down at a high speed by way of the descending motion of the upper table 18 until the punch tool assembly for box bending 10 is positioned at a predetermined second height position that is lower than the height of the side flange Mf by the thickness of the expanded portion 36*e* (see FIGS. 8(*a*) and 8(*b*)). Then, the descending motion of the upper table 18 is temporarily stopped (see FIG. 8(*b*)), and the workpiece W is set on the die tool 12 such that the portion to be bent of the workpiece W is positioned at the center of the V groove (not shown) of the die tool 12 while avoiding interference between the expanded portion 36*e* and the side flange Mf (see FIG. 8(*c*)). After that, the descending motion of the upper table 18 is resumed. As a result, the portion to be bent of the workpiece W can be bent while omitting the first interference avoiding operation of the punch tool with an expanded portion 14 (see FIG. 8(*d*)).

Figure 9:
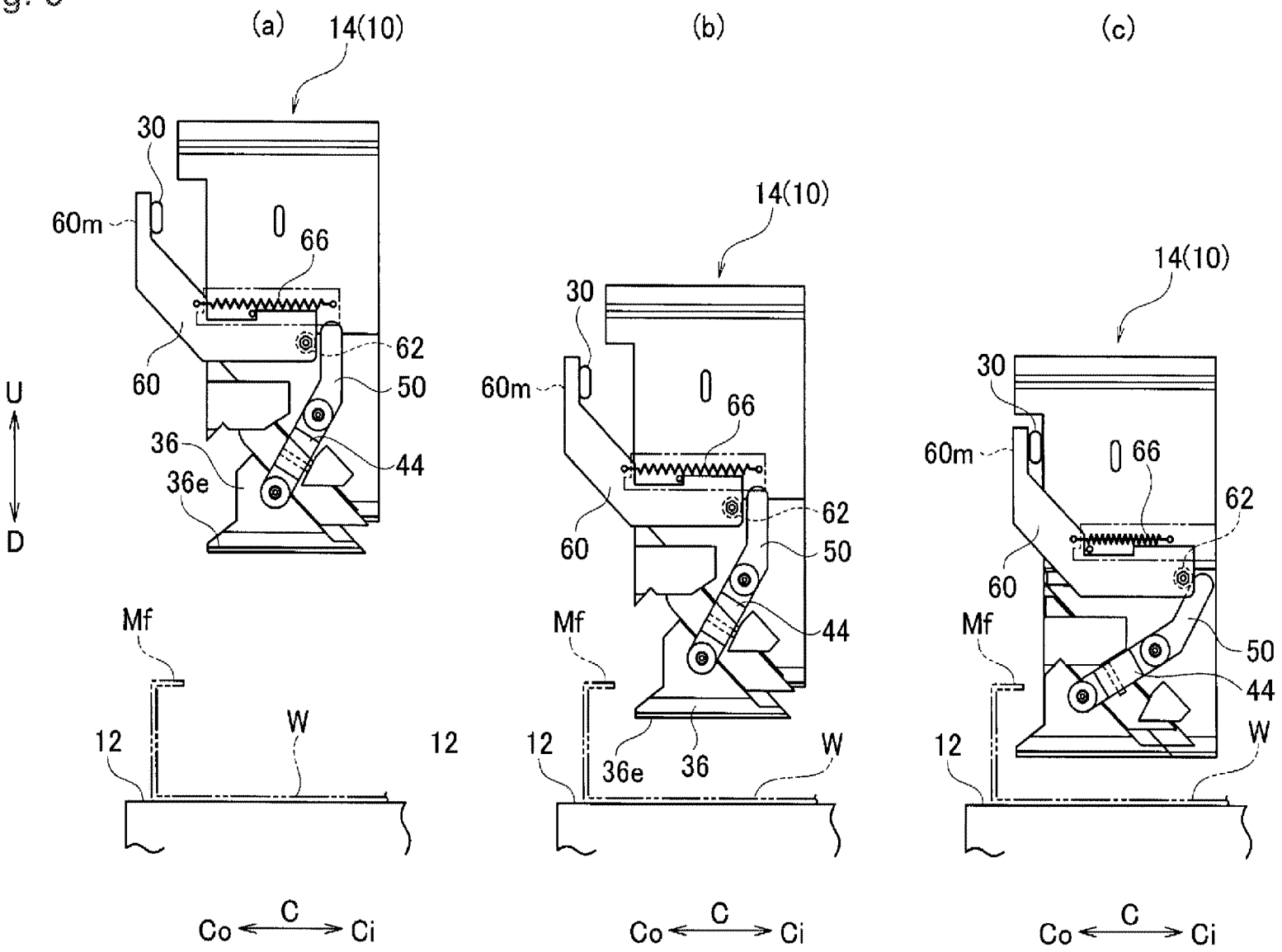
FIGS. 9(*a*), 9(*b*) and 9(*c*) are diagrams for describing the method of operating the punch tool with an expanded portion.
Figure 10:
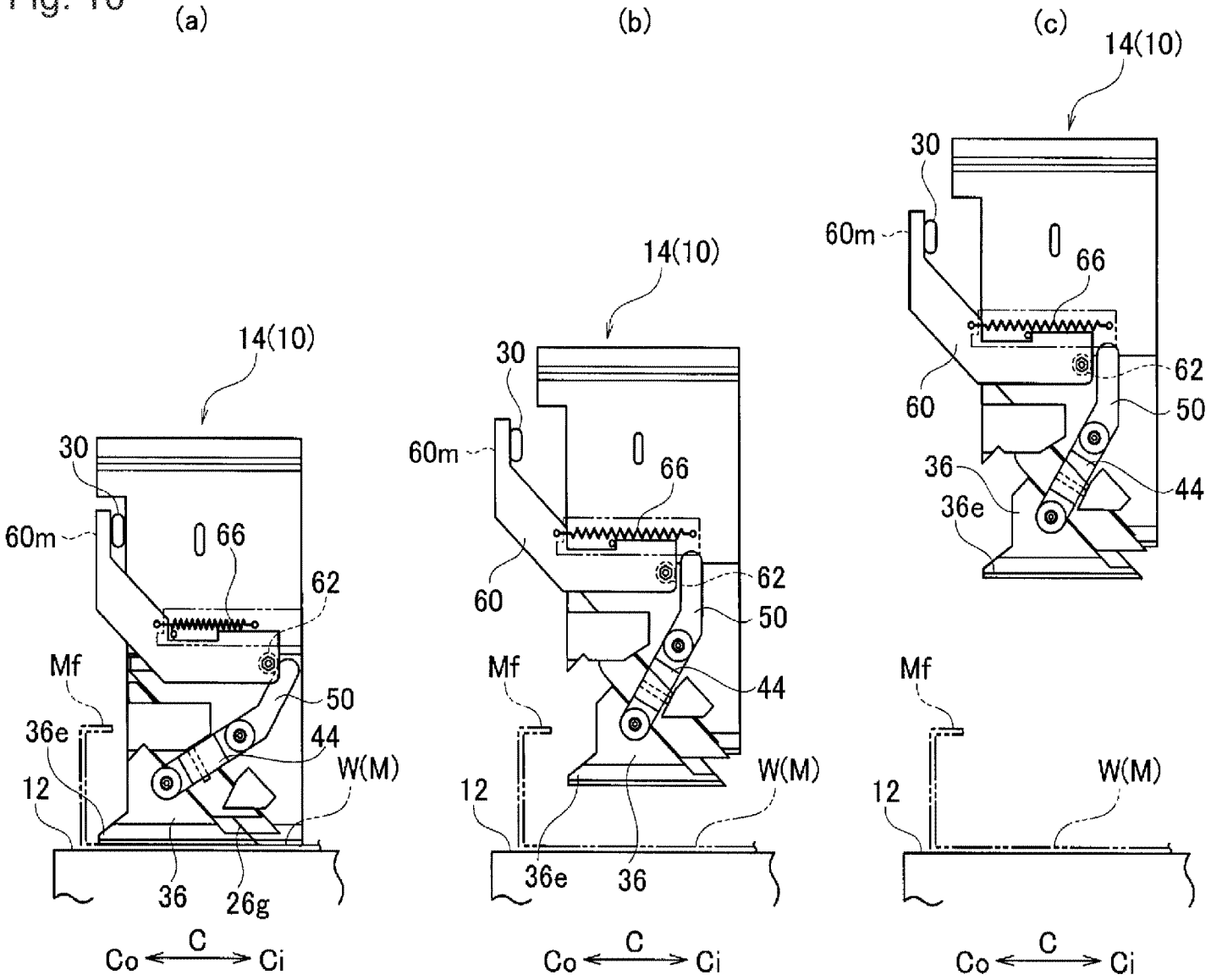
FIGS. 10(*a*), 10(*b*) and 10(*c*) are diagrams for describing the method of operating the punch tool with an expanded portion.

As shown in FIGS. 9 and 10, the following operation will be performed in a case where the side flange Mf is positioned directly under the expanded portion 36*e* before any one of the portions to be bent of the workpiece W held by the bending robot is bent. It should be noted that when bending such as box-bending is performed by using the bending robot, the press brake is not equipped with the optical safety device.

First, the tool retention member 30 is moved to one side in the left-right direction. The moving motion of the tool retention member 30 causes the operation member 60 to move toward the outside in the lateral direction against the urging force of the tension spring 66. Then, the movable punch 36 moves toward the inside in the lateral direction while moving down relatively to the fixed punch 26, due to a self-weight thereof, up to the descending end on the fixed punch 26 (see FIG. 9(*a*)). After that, until the punch tool assembly for box bending 10 (the punch tool with an expanded portion 14) is positioned at the predetermined first height position slightly higher than the height of the side flange Mf, the punch tool assembly for box bending 10 is moved down at a high speed by way of the descending motion of the upper table 18.

Immediately after the punch tool assembly for box bending 10 is positioned at the predetermined first height position, the punch tool assembly for box bending 10 is moved down at a low speed. Then, after the entire expanded portion 36*e* is positioned at a height position lower than the side flange Mf, the tool retention member 30 is moved to the other side in the left-right direction. When the moving motion of the tool retention member 30 is performed, in combination with the urging force of the tension spring 66, the operation member 60 moves toward the inside in the lateral direction. Then, with the cam follower 62 and the interlocking member 50 being abutted with each other, the movable punch 36 moves toward the outside in the lateral direction so that the expanded portion 36*e* is positioned directly below the side flange Mf while moving up relatively to the fixed punch 26 up to the ascending end on the fixed punch 26 (see FIGS. 9(*b*) and 9(*c*)). As a result, the portion to be bent of the workpiece W can be bent while avoiding interference between the expanded portion 36*e* and the side flange Mf (see FIG. 10(*a*)).

Further, as shown in FIG. 10, the following operation will be performed in a case where the side flange Mf is positioned directly above the expanded portion 36*e* immediately after any one of the portions to be bent of the workpiece W with the side flange Mf held by the bending robot is bent.

When the punch tool assembly for box bending 10 (the punch tool with an expanded portion 14) is moved up by way of the ascending motion of the upper table 18, the tool retention member 30 is moved to one side in the left-right direction. The moving motion of the tool retention member 30 causes the operation member 60 to move toward the outside in the lateral direction against the urging force of the tension spring 66. Then, the movable punch 36 moves toward the inside in the lateral direction so as to avoid interference between the expanded portion 36*e* and the side flange Mf while moving down relatively to the fixed punch 26, due to a self-weight thereof, up to the descending end on the fixed punch 26 ((See FIG. 10(*b*), the second interference avoiding operation of the punch tool with an expanded portion 14). As a result, the punch tool with an expanded portion 14 can be pulled out from the workpiece W or the product M while avoiding interference between the expanded portion 36*e* and the side flange Mf (see FIG. 10(*c*)).

[Operation and Effect Specific to the Embodiment]

In a case where the side flange Mf (the inner flange) of the workpiece W or the product is positioned directly above the expanded portion 36*e* immediately after the portion to be bent of the workpiece W is bent, the punch tool with an expanded portion 14 is operated as follows. When the punch tool with an expanded portion 14 is moved up relatively to the die tool 12, the moving motion of the external operation member (the tool retention member 30) causes the operation member 60 to move toward the outside in the lateral direction against the urging force of the urging member (the tension spring 66). Then, the movable punch 36 moves toward the inside in the lateral direction so as to avoid interference between the expanded portion 36*e* and the side flange Mf while moving down relatively to the fixed punch 26 due to a self-weight thereof. As a result, the punch tool with an expanded portion 14 can be pulled out from the workpiece W or the product while avoiding interference between the expanded portion 36*e* and the side flange Mf.

As described above, the punch tool with an expanded portion 14 is configured such that the distal end of the movable punch 36 is aligned with the distal end of the fixed punch 26 with the cam follower 62 being abutted with the interlocking member 50 by the urging force of the tension spring 66 before coming into contact with the workpiece W. Therefore, when the press brake is equipped with an optical safety device, the movable punch 36 does not block a monitoring beam from the projector of the optical safety device.

As described above, the operation member 60 is moved in the lateral direction by way of the moving motion of the tool retention member 30 in the left-right direction. The cam follower 62 of the operation member 60 can be abutted with the interlocking member 50 that moves in the lateral direction in interlock with the relative ascending and descending motion of the movable punch 36. The punch tool with an expanded portion 14 is configured such that the abutting state between the cam follower 62 and the interlocking member 50 is released immediately after the operation member 60 moves toward the outside in the lateral direction against the urging force of the tension spring 66 and the movable punch 36 is positioned at the descending end on the fixed punch 26. Therefore, the movable punch 36 can be moved up and down relatively to the fixed punch 26 in the direction along the inclined portion 26*g* of the fixed punch 26 without using an actuator such as an air cylinder. In other words, the actuator such as the air cylinder can be excluded from the components of the punch tool with an expanded portion 14.

Therefore, according to the embodiment, when the press brake is equipped with the optical safety device, the monitoring operation by the optical safety device can be stably performed while suppressing the increase in size and the complexity of the configuration of the punch tool with an expanded portion 14.

It should be noted that the present disclosure is not limited to the description of the embodiment described above, and can be implemented in various aspects, for example, as follows.

Instead of moving up and down the punch tool assembly for box bending 10 including the pair of punch tools each with an expanded portion 14 by way of the ascending and descending motion of the upper table 18, the die tool 12 may be moved up and down by way of the ascending and descending motion of the lower table 22. In other words, the punch tool assembly for box bending 10 may be moved up and down relatively to the die tool 12. Further, instead of using the tool retention member 30 of the punch tool changing unit as the external operation member, a moving body provided on the back side or the front side of the upper table 18 so as to be movable in the left-right direction may be used as the external operation member.

Then, the scope of rights included in the present disclosure encompasses not only the case in which the punch tool with an expanded portion 14 is retained by the punch holder 20 of the press brake equipped with the optical safety device but also the case in which the punch tool with an expanded portion 14 is retained by the punch holder 20 of the press brake not equipped with the optical safety device. Further, the scope of rights included in the present invention encompasses not only the case in which the punch tool with an expanded portion 14 is retained by the punch holder 20 but also the punch tool with an expanded portion 14 before being retained by the punch holder 20.

The disclosure of the present application is related to the subject matter described in Japanese Patent Application No. 2019-182635 filed on Oct. 3, 2019, the entire disclosure of which is incorporated herein by reference.

The invention claimed is:

1. A punch tool with an expanded portion, the punch tool comprising:

a fixed punch including an inclined portion inclined with respect to a vertical direction;

a movable punch provided on the fixed punch so as to be able to move up and down in a direction along the inclined portion and including an expanded portion projecting toward an outside of the punch tool in a lateral direction;

an interlocking lever configured to move by way of a relative ascending and descending motion of the movable punch with respect to the fixed punch;

an operation member provided on the fixed punch so as to be movable in the lateral direction, the operation member being configured to move in the lateral direction by way of a moving motion of an external operation plate, the operation member including an abutting element capable of being abutted with the interlocking lever, the operation member being configured to perform the relative ascending and descending motion of the movable punch; and a spring configured to urge the operation member toward an inside of the punch tool in the lateral direction such that the abutting element is abutted with the interlocking lever, wherein the movable punch is configured to move toward the inside of the punch tool in the lateral direction while moving down relatively to the fixed punch due to a self-weight thereof when the operation member is moved toward the outside of the punch tool in the lateral direction against an urging force of the spring by way of the moving motion of the external operation plate.

2. The punch tool with an expanded portion according to claim 1, further comprising:

a coupling link configured to couple the fixed punch and the movable punch, wherein the interlocking lever is provided on the coupling link.

3. The punch tool with an expanded portion according to claim 1, wherein an abutting state between the abutting element and the interlocking lever is released immediately after the operation member moves toward the outside in the lateral direction and the movable punch is positioned at a descending end on the fixed punch.

4. The punch tool with an expanded portion according to claim 1, wherein the external operation plate is a tool retention member in a punch tool changing unit provided on an upper table of a press brake, and an engagement hole for engaging the tool retention member is formed on the fixed punch, the operation member includes an operated part for abutting or engaging the tool retention member, and the operated part is positioned at the same height position as the engagement hole.

5. A method of operating a punch tool with an expanded portion, the punch tool including a fixed punch including an inclined portion inclined with respect to a vertical direction, a movable punch provided to the fixed punch so as to be able to move up and down in a direction along the inclined portion and including an expanded portion projecting toward an outside in a lateral direction, an interlocking lever configured to move by way of a relative ascending and descending motion of the movable punch with respect to the fixed punch, an operation member provided on the fixed punch so as to be movable in the lateral direction, the operation member including an abutting element capable of being abutted with the interlocking lever, the operation member being configured to perform the relative ascending and descending motion of the movable punch, and a spring configured to urge the operation member toward an inside of the punch tool in the lateral direction such that the abutting element is abutted with the interlocking lever, the method comprising:

when a side flange of the workpiece or a product is positioned directly above the expanded portion immediately after a portion to be bent of a plate-shaped workpiece is bent, moving, by a moving motion of an external operation plate, the operation member toward the outside of the punch tool in the lateral direction against an urging force of the spring when the punch tool with an expanded portion is moved up relatively to a die tool, thereby moving the movable punch toward the inside of the punch tool in the lateral direction so as to avoid interference between the expanded portion and the side flange while moving down relatively to the fixed punch due to a self-weight thereof.

6. The method of operating a punch tool with an expanded portion according to claim 5, further comprising:

when the side flange is positioned directly under the expanded portion before the portion to be bent of the workpiece is bent, moving, by the moving motion of the external operation plate, the operation member toward the outside in the lateral direction against the urging force of the spring when the punch tool with an expanded portion is moved down relatively to the die tool, thereby moving the movable punch toward the inside in the lateral direction so as to avoid interference between the expanded portion and the side flange while moving down relatively to the fixed punch due to a self-weight thereof, and further moving by the moving motion of the external operation plate, the operation member to move toward the inside in the lateral direction, thereby, with the abutting element and the interlocking lever being abutted with each other, moving the movable punch toward the outside in the lateral direction such that the expanded portion is positioned directly below the side flange while moving up relatively with respect to the fixed punch.

7. The method of operating a punch tool with an expanded portion according to claim 5, wherein the external operation plate is a tool retention member in a punch tool changing unit provided on an upper table of a press brake.

* * * * *